US005549517A

United States Patent [19]

Ikemoto

[11] Patent Number: 5,549,517

[45] Date of Patent: Aug. 27, 1996

[54] GOLF BALL SETTING APPARATUS

[75] Inventor: Yasuyuki Ikemoto, Uji, Japan

[73] Assignee: Ikemoto Shatai Kogyo Co., Ltd., Uji, Japan

[21] Appl. No.: 432,052

[22] Filed: Apr. 28, 1995

[30] Foreign Application Priority Data

Jun. 10, 1994 [JP] Japan ..... 6-152691

[51] Int. Cl.[6] ..... A63B 57/00

[52] U.S. Cl. ..... 473/134; 473/136

[58] Field of Search ..... 273/33, 201

[56] References Cited

U.S. PATENT DOCUMENTS

| | | | |
|---|---|---|---|
| 2,295,599 | 9/1942 | Mozel | 273/201 |
| 3,549,152 | 12/1970 | Gentiluomo | 273/201 |
| 3,778,067 | 12/1973 | Gentiluomo | 273/201 |
| 4,981,299 | 1/1991 | Petrillo | 273/201 |
| 5,078,401 | 1/1992 | Fehrenbach et al. | 273/201 |

FOREIGN PATENT DOCUMENTS

| | | | |
|---|---|---|---|
| 4317673 | 11/1992 | Japan | 273/201 |

*Primary Examiner*—Steven B. Wong

*Attorney, Agent, or Firm*—Morgan & Finnegan, L.L.P.

[57] ABSTRACT

A golf ball setting apparatus for feeding onto a tee a golf ball advanced by gravity to a forward end of a ball supply chute via a rotating ball feeder disk having a feed pawl in accordance with a signal from a ball sensor which indicates no golf ball on the tee, comprising a ball stopper disposed above the chute, the ball stopper having a front end pivotable between a lower position at which the front end lockingly engages a golf ball adjacent the forward end of the chute and an upper position at which the front end does not lockingly engage the ball, the ball stopper being held in engagement with a spring urging the front end to move so as to constantly assume the lower position, and with a ball releasing solenoid for moving the front end to the upper position against the force of the spring when the solenoid is excited. The solenoid is controlled by a control system including a ball release timer defining excitation time so that the solenoid is not excited in the event of any abnormal function of the ball sensor such as the sensor sensing a no-ball condition despite the presence of a ball. Therefore, in the event of such abnormal function of the ball sensor, golf balls on the chute are prevented by the ball stopper from advancing toward the forward end of the chute, no golf ball being supplied to the tee even when the disk is rotated in response to a non-ball signal.

2 Claims, 3 Drawing Sheets

GOLF BALL SETTING APPARATUS

BACKGROUND OF THE INVENTION

The present invention relates to improvements in a golf ball setting apparatus for setting a golf ball at a hitting position on a ball hitting floor so as for the ball to be ready for being hit, the apparatus being designed for installation under such a floor in a golf training facility or the like.

Conventional golf ball setting apparatuses of this type typically include, as described in Japanese Utility Model Publication Nos. 46133 of 1976 and 25654 of 1993, a cylindrical (hollow) tee to be driven by an electric motor via a tee elevating crank mechanism for vertical movement between a ball hitting position in an upper limit zone and a ball receiving position in a lower limit zone, a ball feeder disk (roller) having a feed pawl which is disposed sidewise of a path for vertical movement of the tee and is to be driven by the motor in conjunction with the crank mechanism for rotation in a direction oriented toward the vertical movement path of the tee, a ball supply (successive supply) chute facing toward the disk so as to permit a golf ball on the forward end of the chute to be fed for engagement with the feed pawl at the side thereof opposite to the vertical movement path of the tee, a photoelectric ball sensor for sensing the presence or absence of a golf ball on the tee which is disposed so as to face toward a hollow portion of the tee, a tee ascent sensor disposed adjacent the crank mechanism for sensing the ascent of the tee to the upper limit zone, and control means (a control circuit) which actuates the motor in response to a no-ball signal from the ball sensor thereby to elevate the tee through the crank mechanism after the tee is lowered and, simultaneously thereupon, deliver via the disk the golf ball on the forward end of the chute onto the tee as the tee passes through the lower limit zone, allowing balls on the chute to advance by gravity one ball ahead, and which thereafter stops the operation of the motor in response to the disappearance of the no-ball signal, that is, in response to a ball-present signal from the ball sensor due to ball reception by the tee and to a subsequent signal from the tee ascent sensor indicating the ascent of the tee to the upper limit zone, thereby causing the golf-ball supporting tee to rest at a ball hitting position in the upper limit zone.

In such a conventional golf ball setting apparatus, even when there occurs some abnormality with any constituent element other than the ball sensor, the abnormality will not affect other components. However, in the event of an abnormal operation such that due to some abnormal function (failure) of the photoreceptive element or the like the ball sensor should detect a no-ball condition despite there being present a ball, the motor would be actuated in a continual series to allow repetitive operation of golf ball supply onto the tee. As a consequence, golf balls are successively supplied from the chute and toward the path for vertical movement of the tee. This poses a serious problem that golf balls gather in the vicinity of the vertical movement path for the tee, which will eventually hinder the operation of the tee and other components and even damage them.

SUMMARY OF THE INVENTION

In view of the above mentioned problem with such conventional golf ball setting apparatus, the present invention has as its principal object the provision of a simple arrangement to prevent successive feeding of golf balls in the event of abnormal ball-sensor functioning.

According to the invention, this object can be accomplished by a golf ball setting apparatus comprising, in addition to those components which make up the foregoing conventional golf ball setting apparatus, including a tee elevating crank mechanism and a ball feeder disk, both driven by an electric motor, a ball supply (successive supply) chute, a ball sensor, and a tee ascent sensor, a ball stopper vertically movably disposed above the chute, the ball stopper having a front end vertically movable between a ball restraining position at which the front end lockingly engages a golf ball at a position adjacent to the forward end of the chute (i.e., a second position) and a ball releasing (non-restraining) position at which the front end does not engage the golf ball, the ball stopper being held in engagement with a spring urging the front end to move downwardly so as to constantly assume the ball restraining position, and with a ball release solenoid for moving the front end upwardly against the force of the spring so as to allow the front end to assume the ball releasing position, a ball release (solenoid excitation) timer which regulates time for excitation of the ball releasing solenoid, and control means (a control circuit) which excites the ball releasing solenoid for a time period set by the timer in response to a no-ball signal from the ball sensor so that the golf ball at a restraining position adjacent to the forward end of the chute is advanced by gravity to the forward end of the chute and then a golf ball advanced anew to the position adjacent to the forward end is restrained thereat, and which then actuates the motor to move the tee downward and upward via the crank mechanism and, simultaneously thereupon, delivers a golf ball advanced to the forward end of the chute onto the tee as the tee passes through the lower limit zone, the control means being then operative to stop the operation of the motor in response to the disappearance of the no-ball signal, that is, in response to a ball-present signal from the ball sensor due to ball reception by the tee and to a signal from the tee ascent sensor indicating the ascent of the tee to the upper limit zone, thereby causing the tee, with a golf ball placed thereon, to rest at a ball hitting position in the upper limit zone, the timer being then reset.

The front end of the ball stopper may be curved so as to closely contact the upper portion of a golf ball.

In the golf ball setting apparatus according to the invention, when the operation of the ball sensor is normal, the ball release solenoid is excited for the predetermined period of time as regulated by the timer, so that the front end of the ball stopper moves to the ball releasing position and, after the lapse of a predetermined time period, the front end returns to the ball restraining position. Thus, the golf ball at a position adjacent the forward end of the chute is advanced to the forward end, and a golf ball advanced anew to the position adjacent the forward end is restrained from further advance. Thereafter, the motor is driven to actuate the tee to descend and then ascend via the crank mechanism, whereupon the golf ball at the forward end of the chute is delivered via the disk onto the tee which is moving through the lower limit zone. Then, the operation of the motor is stopped in response to the disappearance of no-ball signal from the ball sensor and a subsequent signal from the tee ascent sensor indicating the ascent of the tee up to the upper limit zone. Thereupon, the timer is to complete a cycle of golf ball setting.

If, during the process of the above described operation, the ball sensor should erroneously sense a ball-present condition as a no-ball condition, the timer will not be reset and the predetermined time for counting is simply allowed to lapse. Therefore, with the ball release solenoid relieved of excitation, the ball stopper is in a ball restraining condition and the motor is merely driven to perform no-ball feed run. Therefore, the arrangement of the invention involves no such possibility that golf balls are successively fed toward the path of vertical tee movement with the result that golf balls gather in the vicinity of the path, thus interfering with the operation of the tee and other components and/or damaging them, as has hitherto been often encountered.

The golf ball setting apparatus according to the invention will be described hereinafter with reference to FIGS. 1 through 5.

DETAILED DESCRIPTION

Figure 1:
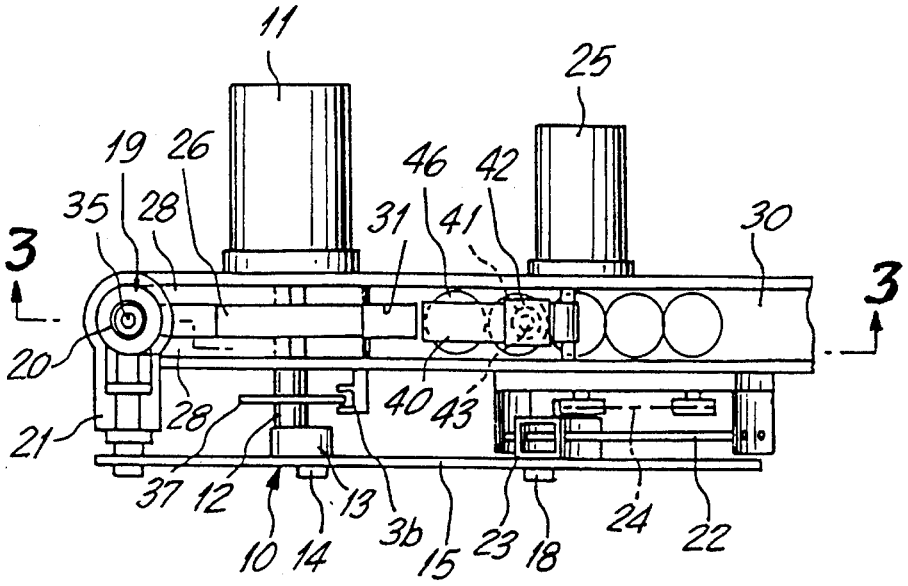
FIG. 1 is a plan view showing a principal portion of one embodiment of the golf ball setting apparatus in accordance with the invention.
Figure 2:
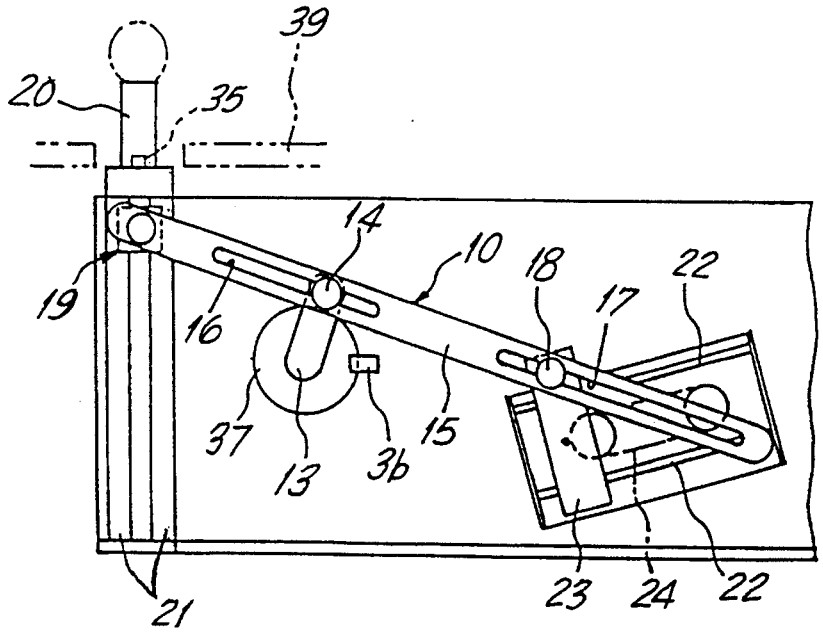
FIG. 2 is a front view of a principal portion of the embodiment shown in FIG. 1.

In the embodiment shown, a tee elevating crank mechanism 10 includes a crank 13 with a crank pin 14 connected to the front end of a horizontal output shaft 12 of an electric motor 11, a horizontally extending link 15 having an elongate slot 16 formed in a mid-portion thereof and an elongate slot 17 formed in a base portion which are respectively engaged by the crank pin 14 and a movable fulcrum pin 18, and a tee base with a cylindrical tee 20 which slidingly engages a vertical guide 21. When the motor 11 is actuated (turned ON), the crank 13 is rotated through the rotation of the output shaft 12, so that the link 15 can be pivotally moved upward and downward about the fulcrum pin 18, whereby the tee 20 may be moved upward and downward between a hitting position on a hitting floor 39 and a ball receiving position therebelow. The fulcrum pin 18 is provided on a pin supporting base 23 movable along a horizontal guide 22 extending generally in the direction in which the link 15 extends. The pin support base 23 is fixed to a chain 24 of a chain mechanism extending parallel to a horizontal guide 22. Therefore, by horizontally displacing the chain 24 through the actuation of a chain driving electric motor 25. it is possible to change the position of the pin support base 23 on the guide 22, or change the positon (spacing) of the fulcrum pin 18 relative to the vertical path of movement defined by the vertical guide 21, so that the height of an upper limit zone of the tee 20, that is, the level of a ball hitting position, can be infinitely changed.

Figure 3:
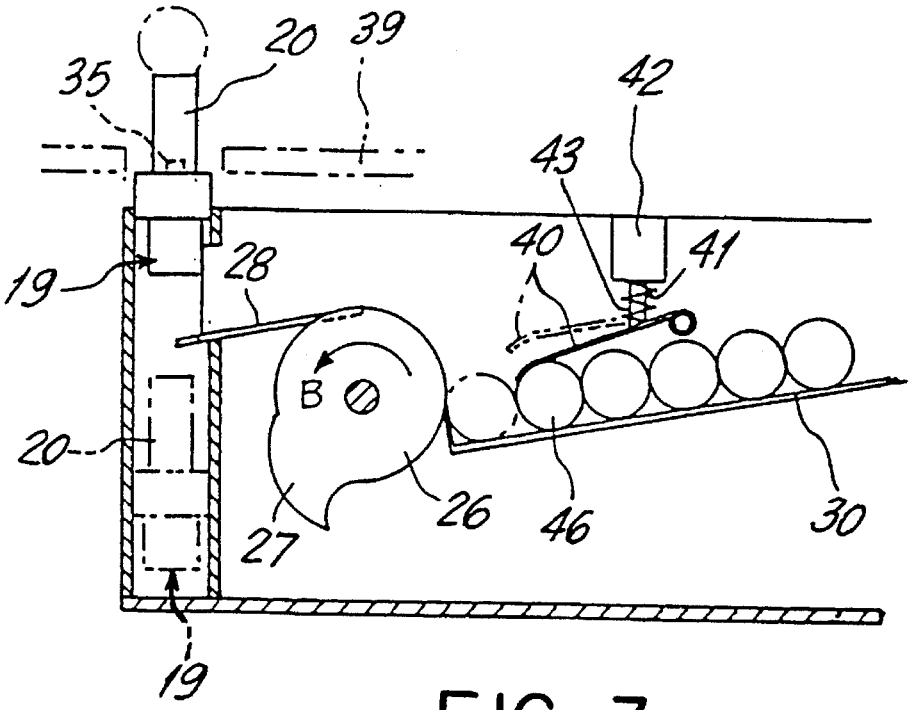
FIG. 3 is a front view cut away substantially along the line A—A in FIG. 1.

A ball feeder disk (roller) 26 with a feed pawl 27 is mounted to a base portion of the output shaft 12 of the motor 11 which corresponds to a sidewise site relative to the vertical movement path of the tee 20 in such a way that the pawl 27 is positioned in the lower limit zone when the tee 20 is positioned in the upper limit zone (see FIG. 3). Therefore, as the disk 26 rotates in the direction of arrow B (FIG. 3) through the run of the motor 11, the disk 26 can feed a golf ball to the tee 20, as positioned in the lower limit zone, through a pair of ball guide chute 28 extending from a portion adjacent the upper end thereof toward vertical path of tee movement and spaced so as to permit the rotation of the pawl 27.

A ball supply chute 30 extends, at an opposite side relative to the vertical movement path of the tee 20, from a ball hopper portion not shown in such a way that it faces a lower portion of the disk 26, and the forward end of the chute 30 for receiving a forwardmost ball is formed with a notch 31 which permits rotation of the pawl 27 of the disk 26.

A photoelectric ball sensor 35 is mounted to the tee support base 19 in such a condition that it faces a hollow portion of the tee 20. A tee ascent sensor 36 comprises a photoelectric switch disposed at an edge portion of a disk 37 formed with an edge hole (not shown) which is fixed to a median portion of the output shaft 12 of the motor 11, the photoelectric switch being so oriented as to detect the edge hole at a pivoted position corresponding to the ascent of the tee 20 to the upper limit zone.

A ball stopper 40 is comprised of a plate shaped lever member having a front end portion bent in a hook-like fashion so as to restrainingly engage an upper portion of a golf ball as a hook or presser or weir does, and is upward and downward pivotally disposed above the chute 30 with the base end of the ball stopper 40 as a fulcrum so that the front end of the ball stopper 40 can assume a ball restraining position (shown by solid line) at which it goes in locking contact with the upper portion of a golf ball at a location adjacent to the front end and a ball release position (shown in phantom) at which the front end goes away from the top of the ball. Above the ball stopper 40 midway of the length thereof there is disposed a coil spring 41 urging the ball stopper 40 to pivot downward so that the front end of the ball stopper 40 will constantly assume the ball restrainig position. Also, an upward and downward movable control plunger 43 for a ball release solenoid 42 is provided, with its front end fixed to the mid-point of the ball stopper 40, to cause the front end to pivotally move upward so that the front end may assume the ball release position against the action of the coil spring 41. The solenoid 42 has an excitation time (t) defined by a ball release timer 44 of the time count-up type (FIG. 4).

Control means 45 (FIG. 4) comprises a computer (microprocessor) and perform operation in the followong sequence. The solenoid 42 is excited a predetermined time (t) by the timer 44 in response to an output signal of no-ball from the ball sensor 35, and then the excitation is cleared so that a golf ball 46 at a position adjacent to the front end of the ball stopper 40 which has been restrained by the front end is advanced to the forward end of the chute 30 for engagement by the pawl 27 of the disk 26. Then, a golf ball advanced anew to the position adjacent to the front end is restrained by the ball stopper 40. Then, the motor 11 is driven to move the tee 20 downward and then upward through the crank mechanism 10 and, simultaneously therewith, the golf ball which has advanced from the disk 26 to the forward end of the chute 30 via the ball guide chute 28 is delivered onto the tee 20 as the tee passes through the lower limit zone. The operation of the motor 11 is stopped in response to the disappearance of an output signal of no ball (output signal of ball present) from the ball sensor 35 due to ball reception by the tee 20 so that the tee 20, with the ball received therein, is caused to rest at the ball hitting position on the hitting floor 39 in the upper limit zone. Then, the timer 44 is reset.

Figure 4:
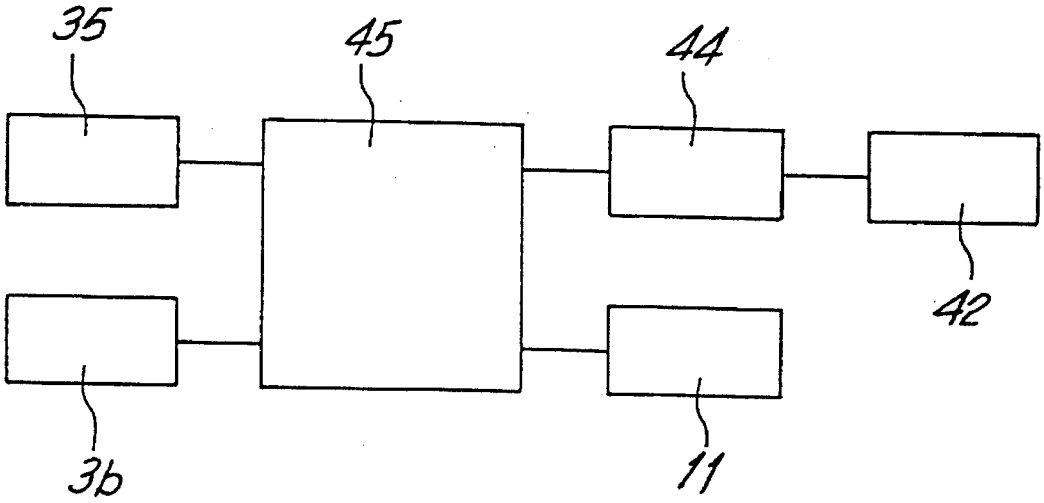
FIG. 4 is a block diagram showing an operation control system of the embodiment shown in FIG. 1.
Figure 5:
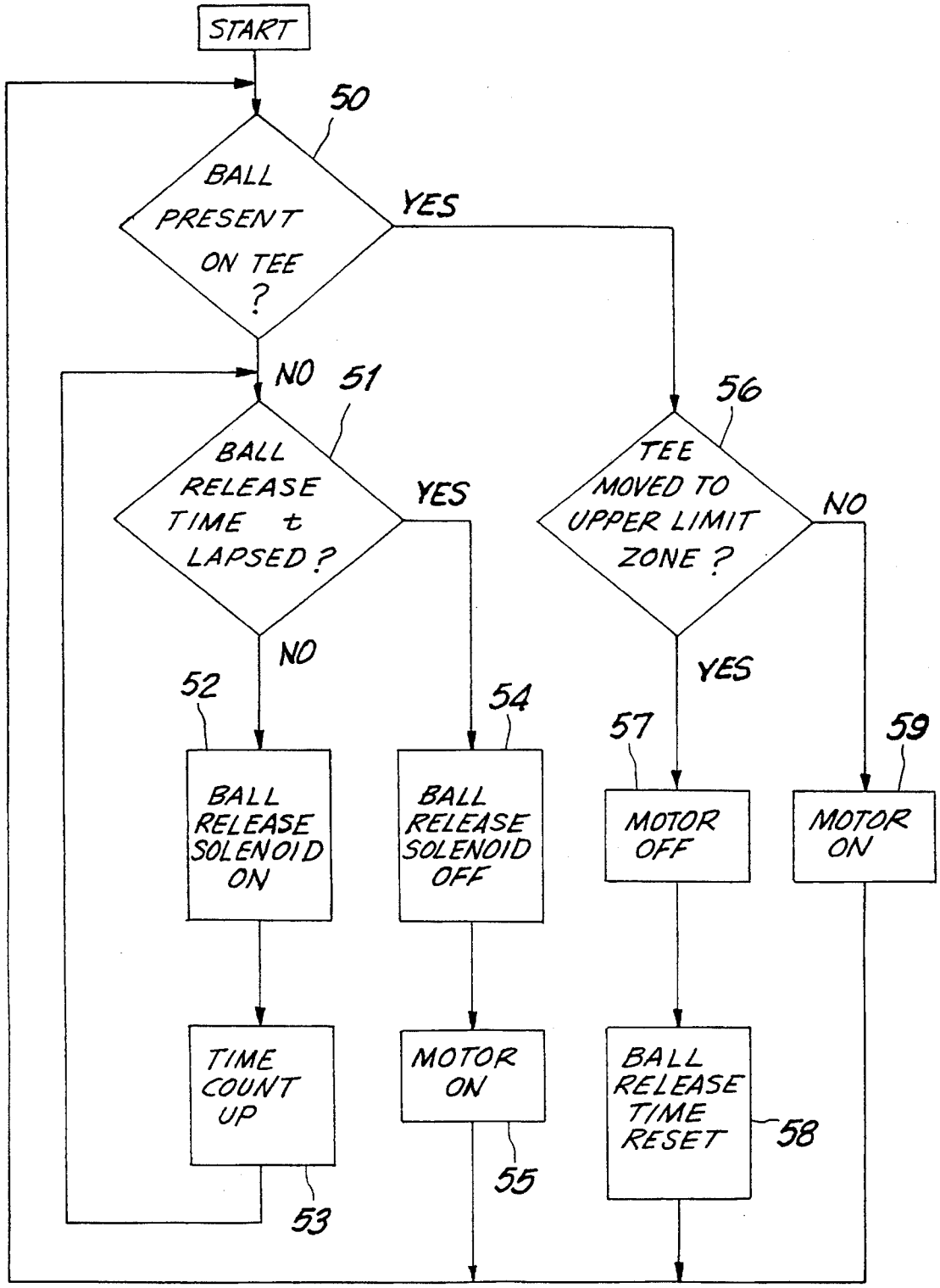
FIG. 5 is flow chart of an operating program with respect to the embodiment shown in FIG. 1.

The illustrated golf ball setting apparatus, as shown in FIG. 4 block diagram of the operation control system (electric circuit) and FIG. 5 flow chart of an operating program, unless there is an abnormality with the ball sensor 35, for each signal of no ball from the ball sensor 35 at step 50, the solenoid 42 is excited (ON) a time (t) preset by the timer 44 at step 51, across step 53 (step 52), and then the excitation is cleared (OFF) (step 54). Thus, through the movement of the ball stopper 40 to the ball release position and the return of the ball stopper 40 to the ball restraining position after lapse of the preset time (t), the golf ball 46 at a position adjacent to the front end is advanced to the forward end of the chute 30 and a ball moved anew to the position adjacent to the front end is restrained from further advance (see FIG. 3).

Next, the motor 11 is driven (ON) (step 55) and the tee 20 is lowered and then moved upward through the crank mechanism 10 and, simultaneously thereupon, a golf ball, moved to the forward end of the chute 30 as shown in phantom in FIG. 3, is delivered via the ball guide chute 28 onto the tee 20 in the course of its passage through the lower limit zone, through the rotation of the disk 26 in the direction of arrow B, whereupon the no-ball signal from the ball sensor 35 disappears (step 50). Subsequently, at step 59 the operation of the motor 11 is continued until the tee 20 rises to the upper limit zone. When the ascent of the tee 20 to the upper limit zone is sensed by the tee ascent sensor 36 (step 56), a signal (ON) indicating the ascent of the tee to the upper limit zone is output, and immediately thereupon the operation of the motor 11 is stopped (OFF) (step 57) and the timer 44 is reset (count-up time=0) (step 58). Thus, ball setting to the hitting position is completed.

In the event that the ball sensor 35 should erroneously sense a ball-present condition as a no-ball condition, the timer 44 is not reset and accordingly count-up time at step 51 is still t. With the solenoid 42 cleared of excitation (OFF) (step 54), therefore, operation (ON) of the motor 11 (step 55) simply results in empty feed with respect to golf balls (such empty feed may be stopped by, for example, turning off the main switch of the apparatus).

According to the invention, the construction of the ball stopper 40 may be changed in various ways. The ball stopper 40 may, instead of the upward and downward pivotable lever member as shown, be comprised of a vertically movable member connected to a control plunger capable of moving the solenoid 42 upward and downward (which has at its front end a ball presser portion, a ball hooking portion, a ball restraining portion, or the like). Also, in order to enhance such ball restraining performance, the front end of the ball stopper 40 may be wholly constructed into a curved shape which can contact the upper surface of a golf ball. Also, it is possible to use a plate spring or the like as a spring for urging the ball stopper to the ball restraining position.

While the invention has been shown and described with reference to preferred embodiments thereof, it will be understood by those skill in the art that various changes and modifications may be made within the spirit and scope of the invention.

What is claimed is:

1. A golf ball setting apparatus comprising a cylindrical tee adapted to be driven by an electric motor through a tee elevating crank mechanism for vertical movement between a ball hitting position in an upper limit zone and a ball receiving position in a lower limit zone, a ball feeder disk having a feed pawl disposed sidewise of a path for vertical movement of the tee which is to be driven by the motor in conjunction with the crank mechanism for rotation in a direction oriented toward the vertical movement path of the tee, a ball supply chute facing toward the disk so as to permit a golf ball on the forward end of the chute to be fed for engagement with the pawl at the side thereof opposite to the vertical movement path of the tee, a photoelectric ball sensor for sensing the presence or absence of a golf ball on the tee which is disposed so as to face toward a hollow portion of the tee, a tee ascent sensor disposed adjacent the crank mechanism for sensing the ascent of the tee to the upper limit zone, a ball stopper vertically movably disposed above the chute, the ball stopper having a front end vertically movable between a ball restraining position at which the front end lockingly engages a golf ball at a position adjacent to the forward end of the chute and a ball releasing position at which the front end does not engage the golf ball, the ball stopper being held in engagement with a spring urging the front end to move downwardly so as to constantly assume the ball restraining position, and with a ball release solenoid for moving the front end upwardly against the force of the spring so as to allow the front end to assume the ball releasing position, a ball release timer which regulates time for excitation of the ball releasing solenoid, and control means which excites the solenoid for a time period set by the timer in response to a no-ball signal from the ball sensor so that the golf ball at a restraining position adjacent to the forward end of the chute is advanced by gravity to the forward end of the chute and then a golf ball advanced anew to the position adjacent to the forward end is restrained thereat, and which then actuates the motor to move the tee downward and upward via the crank mechnism and, simultaneously thereupon, delivers a golf ball advanced to the forward end of the chute onto the tee as the tee passes through the lower limit zone, the control means being then operative to stop the operation of the motor in response to the disappearance of the no-ball signal from the ball sensor due to ball reception by the tee and to a signal from the tee ascent sensor indicating the ascent of the tee to the upper limit zone, thereby causing the tee, with a golf ball placed thereon, to rest at a ball hitting position in the upper limit zone, the timer being then reset.

2. A golf ball setting apparatus as set forth in claim 1, wherein the front end of the ball stopper is curved so as to closely contact the upper portion of the golf ball.

* * * * *